US005525022A

United States Patent [19]

Huntoon

[11] Patent Number: 5,525,022

[45] Date of Patent: Jun. 11, 1996

[54] APPARATUS FOR ENGAGING AND LIFTING A REFUSE CONTAINER

[75] Inventor: Russell C. Huntoon, Sparks, Nev.

[73] Assignee: Automated Refuse Equipment, Inc., Reno, Nev.

[21] Appl. No.: 350,421

[22] Filed: Dec. 5, 1994

[51] Int. Cl.[6] ..... B65F 3/04

[52] U.S. Cl. ..... 414/409; 414/408; 414/421; 414/422; 414/553; 901/47

[58] Field of Search ..... 414/408, 409, 414/406, 407, 421, 422, 419, 420, 486, 539, 540, 541, 546, 550, 553, 554, 555; 901/47, 45; 254/133 R, 134, 93 R

[56] References Cited

U.S. PATENT DOCUMENTS

| | | | |
|---|---|---|---|
| 4,057,156 | 11/1977 | Thompson et al. | 414/409 X |
| 4,645,018 | 2/1987 | Garbade et al. . | |
| 4,722,658 | 2/1988 | Würtz et al. | 414/408 |
| 4,824,315 | 4/1989 | Naab et al. . | |
| 4,854,406 | 8/1989 | Appleton et al. . | |
| 4,889,462 | 12/1989 | Naab et al. . | |
| 5,004,392 | 4/1991 | Naab . | |
| 5,062,759 | 11/1991 | Pieperhoff | 414/409 X |
| 5,119,894 | 6/1992 | Crawford et al. . | |
| 5,149,243 | 9/1992 | Naab et al. | 414/408 |
| 5,215,423 | 6/1993 | Schulte-Hinsken et al. . | |

FOREIGN PATENT DOCUMENTS

| | | | |
|---|---|---|---|
| 463386 | 1/1992 | European Pat. Off. | 414/409 |
| 2222813 | 3/1990 | United Kingdom | 414/408 |

OTHER PUBLICATIONS

Eager Beaver Publication—Apr. 12, 1991.

*Primary Examiner*—Frank E. Werner
*Attorney, Agent, or Firm*—Bell, Seltzer, Park & Gibson

[57] ABSTRACT

A refuse collection truck includes a lift arm which mounts a longitudinally moveable slide, and the slide in turn pivotally mounts a faceplate of the type adapted to engage a refuse collection container which is positioned along the roadside. The longitudinal movement of the slide permits the contents of the container to be dumped into a selected one of two chambers of the collection hopper on the track, and where split containers are utilized, the contents of one side of a lifted container may be deposited in one chamber of the hopper and the contents of the other side of the container may be deposited in the other chamber. The pivotal mounting of the faceplate to the slide permits the faceplate to be aligned with misoriented containers.

26 Claims, 5 Drawing Sheets

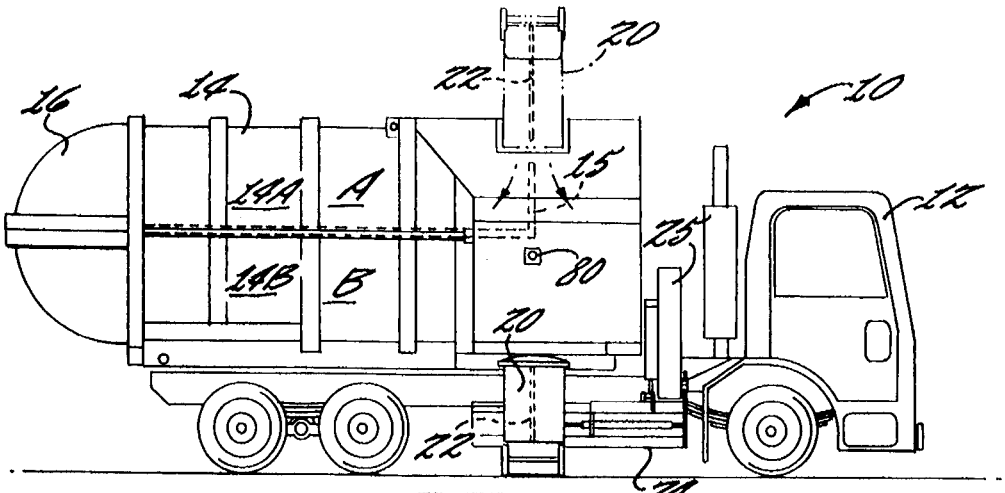
Fig. 1.
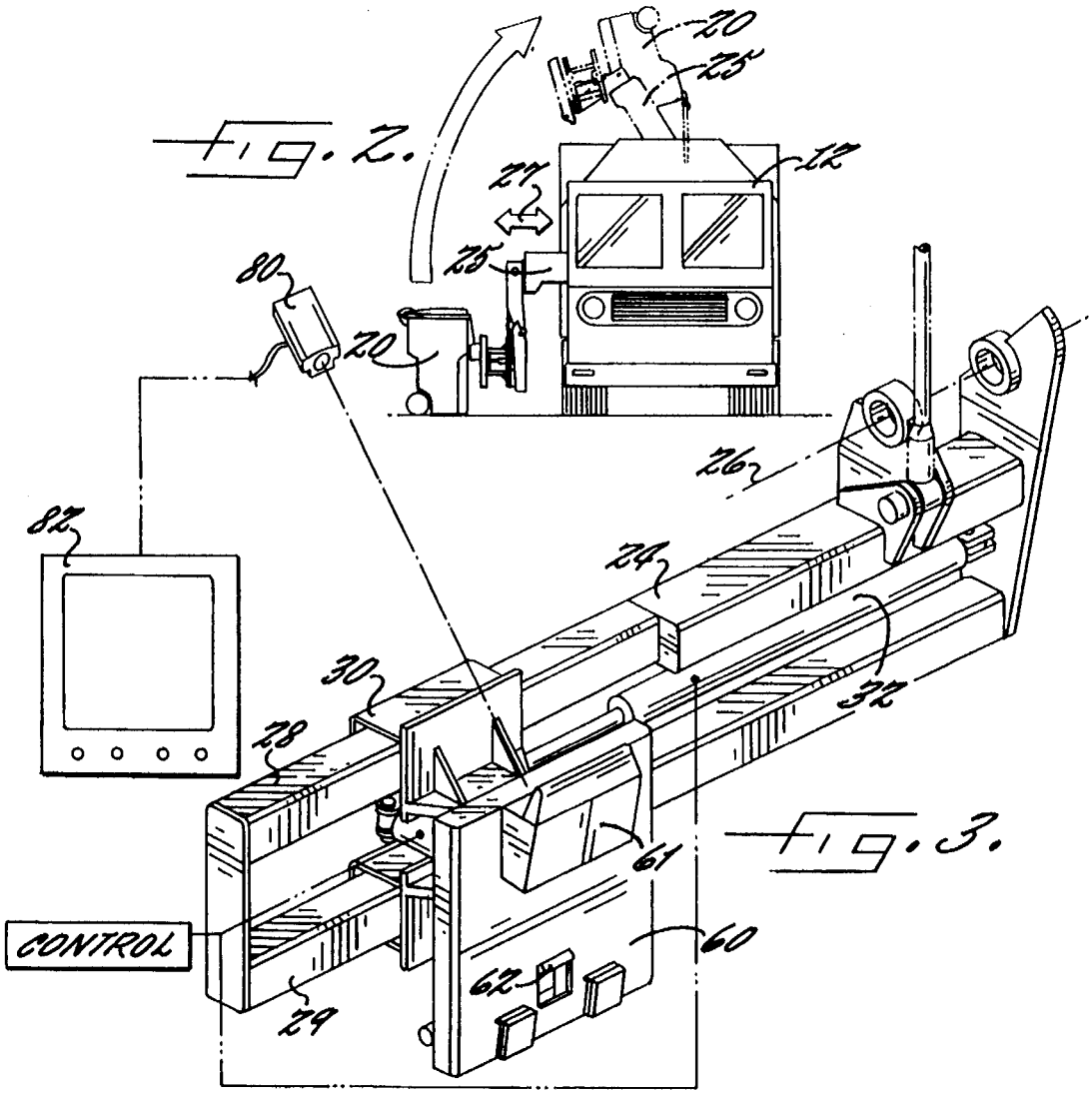
Fig. 2.
Fig. 3.

APPARATUS FOR ENGAGING AND LIFTING A REFUSE CONTAINER

FIELD OF THE INVENTION

The present invention relates to the field of refuse collection systems, and, more particularly, to a steerable faceplate adapted for use with a refuse vehicle for engaging a refuse container to be lifted and dumped into a collection hopper of a refuse truck.

BACKGROUND OF THE INVENTION

The desire to reduce the cost and increase the ease and speed of refuse collection, in conjunction with improvements in automation techniques, has resulted in substantial changes in the collection of residential and commercial refuse. As the technology of carts and lift mechanisms developed, several different styles of carts and lift mechanisms have emerged. However, despite these differences, most modern refuse collection systems include carts having wheels, which allow them to be rolled to the street curb and a refuse vehicle or truck having a cart engaging gripper or faceplate, which is connected to a lift mechanism for lifting the refuse container or cart from a lowered receiving position to a raised dumping position at which the contents of the container fall into the refuse collection hopper of the truck.

Rather than manually lifting a refuse cart into the truck to be emptied, modern refuse collection systems, generally referred to a semi-automated, require the operator to orient the refuse cart so as to be square with the faceplate and then tip the cart so that it engages an engaging member on the faceplate. The operator then activates the lift mechanism to lift and dump the contents of the cart and, once emptied, return the cart to the ground where the operator removes the cart from the faceplate. Examples of such a refuse collection system may be found in U.S. Pat. Nos. 3,738,516 to Wells and 4,479,751 to Wyman et al.

More recently, in a continuing attempt to increase the speed and efficiency of refuse collection, fully automated collection systems have begun to appear. An example of such a system is disclosed in U.S. Pat. No. 4,889,462 to Naab et al. where the operator of the refuse truck moves the faceplate into contact with the refuse cart. If the cart is not square to the faceplate, the contact with the cart causes the faceplate to pivot or deflect from its biased neutral position to allow the cart to thereby be engaged by the engaging elements of the faceplate. Once the cart has been engaged, a setting and blocking cylinder is activated to move the cart and the faceplate back to the neutral position. This approach to engaging a refuse cart is limited by its inability to actively pivot the faceplate, which prevents the cart from being returned to the roadside in its original position.

A further limitation of some of the known collection systems is the fact that they have difficulty engaging containers which are placed immediately next to each other, or next to fixed object such as a mailbox. These collection systems are also unable to engage containers which are severely misoriented or rotated out of alignment with the faceplate. Thus, the operator of the truck is often required to leave the cab so as to align the containers and thereby permit them to be engaged by the faceplate of the truck.

In order to permit segregation and collection of different types of recyclable waste or collect recyclable waste separately from other types of refuse, it has recently been proposed to insert a divider panel into the collection hopper of the refuse truck to divide the collection hopper into two chambers. Such a division allows one chamber to receive recyclable materials and the other chamber receive nonrecyclable materials. Alternatively, it is possible to have each of the two chambers receive a different type of recyclable material. The use of this system requires that the containers be accurately located on one or the other side of the divider panel when in the raised dumping position, so that the contents fall into the proper chamber, depending upon the nature of the contents of the container.

Another refinement of the above system includes the dividing of the refuse container itself into left and right side compartments, which are adapted to receive wastes which have been segregated by the homeowner or other user. To utilize these divided containers, it is necessary to lift and tilt each container so that the divider wall of the container is accurately aligned above the divider panel in the truck, so that the contents of the compartmentalized container fall into the proper chamber in the truck and so as to avoid cross-contamination. Such accurate positioning of the carts is not always possible with several of the presently known lift mechanisms.

Cost and efficiency are essential components of all future refuse collection systems. However, existing semi-automated collection systems still require the operator to leave the truck cab to both place the cart onto the faceplate and remove it once it has been dumped. As a result, the total time it takes to complete a collection route is not substantially reduced. The desire to utilize existing fully automated collection systems is limited by the inability of several of the known approaches to work in confined areas, to engage a cart which is not square to the faceplate or to replace the cart, once emptied, in its original position. Furthermore, some of the existing fully automated collection systems are not well suited for use with a divided cart and a divided collection hopper.

SUMMARY OF THE INVENTION

It is accordingly an object of the present invention to provide an apparatus for engaging and lifting a refuse container, and which permits the contents to be dumped into the refuse collection hopper of the truck, and which overcomes the above noted limitations and disadvantages of the known systems.

It is a more particular object of the present invention to provide an apparatus of the described type which is adapted for use with either a conventional, single hopper truck, or a truck having a divided hopper, and such that the container can be accurately located with respect to the hopper in its raised dump position.

It is still another object of the present invention to provide an apparatus of the described type which is able to be oriented so as to engage misaligned containers along the roadside, and so that the operator of the truck need not leave the cab of the truck.

The above and other objects and advantages of the present invention are achieved in the embodiment illustrated herein by the provision of an apparatus for engaging and lifting a refuse container which comprises a lift arm movable between a lowered receiving position and a raised dumping position, and a faceplate mounted to the lift arm for pivotal movement about a pivot axis which is generally parallel to the faceplate and vertically oriented when the lift arm is in the lowered position. Engaging members are mounted on the faceplate for engaging a refuse container, and a drive system is provided for selectively pivoting the faceplate in each pivotal direction about the pivot axis, and so that the engaging members on the faceplate can be oriented about the pivot axis to engage a misaligned refuse container when the lift arm is in the lowered position.

In the preferred embodiment, a slide is mounted to the lift arm for slideable movement along the longitudinal direction of the arm, and an additional drive system is provided for moving the slide in each longitudinal direction along the lift arm. The faceplate is in turn mounted to the slide, with the drive system for pivoting the faceplate being mounted between the slide and the faceplate.

The faceplate is actively pivotable about the pivot axis between a neutral position, a first pivoted position on one side of the neutral position, and a second pivoted position on the other side of the neutral position. This ability to pivot the faceplate allows the lift arm and the faceplate to be operated as a robotic arm to engage a refuse cart which may positioned adjacent an immovable object such as a building or may be misaligned with respect to the faceplate. In addition, the actively pivotable faceplate also makes it possible to return the empty cart to its original position, even in confined areas.

Further, the drive system for the faceplate includes switch means for, upon being actuated, automatically moving the faceplate to the neutral position. The drive system for the slide comprises means for moving the slide between a central position along the length of the lift arm, a forward position on one side of the central position, and a retracted position on the other side of the central position. Also, the drive means for the slide includes switch means for, upon being actuated, automatically moving the slide to its central position.

Preferably, both the faceplate and the drive system are adapted to be mounted onto an existing lift arm or mechanism. This ability to retrofit an existing refuse truck allows the truck to be converted from a grabber-type fully automated to a face plate type fully automated with relatively little structural modification or cost. To enhance this ability to retrofit the truck, the drive system is preferably pneumatic, thereby obviating the need to tie into the existing hydraulic system on the truck. Alternatively, the drive system may also be either hydraulic and be incorporated into the existing hydraulic system on the truck or it may instead by electric.

A camera is also preferably mounted to the vehicle so as to observe a refuse container positioned adjacent the lift arm, and a video display screen is operatively connected to the camera and positioned in the cab of the vehicle so that the operator of the vehicle can observe the position and/or orientation of the refuse container from the cab. Also, the drive means for the slide and faceplate include controls which are positioned in the cab, so as to be accessible to the operator while observing the video screen. Thus the operator can move and articulate the faceplate to engage the refuse container, without leaving the cab of the vehicle.

BRIEF DESCRIPTION OF THE DRAWINGS some of the objects and advantages of the present invention having been stated, others will appear as the description proceeds, when taken in conjunction with the accompanying drawings, in which:

FIG. 1 is a side elevation view of a refuse collection truck which embodies the features of the present invention, and illustrating the lift arm and refuse container in their lowered position in solid lines, and illustrating the refuse container in its raised position in dashed lines;

FIG. 2 is a front view of the truck shown in FIG. 1, and again illustrating the lift arm and refuse container in the lowered and raised positions;

FIG. 3 is a fragmentary perspective view of the lift arm of the present invention, with the slide in its central position, and further schematically illustrating the video and control systems of the present invention;

DETAILED DESCRIPTION OF THE PREFERRED EMBODIMENTS

Figure 4:
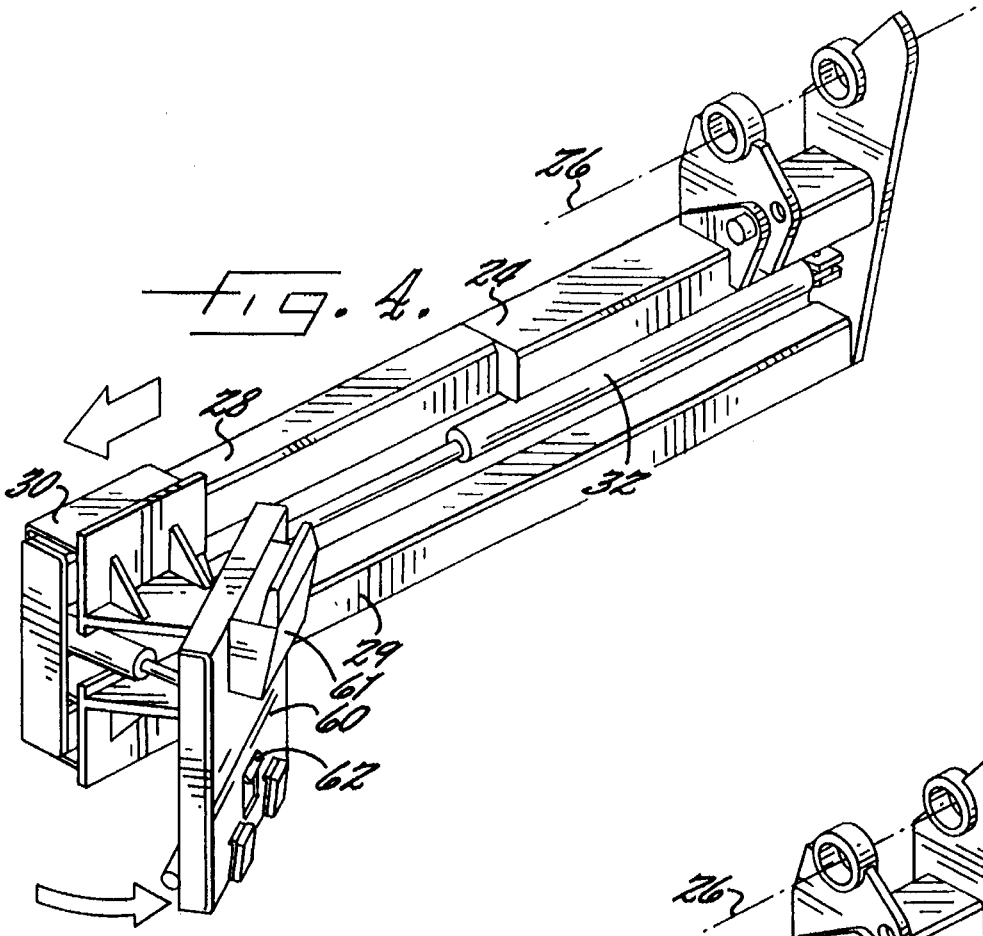
FIGS. 4 and 5 are perspective views which are similar to FIG. 3, but illustrating the slide in its extended and retracted positions respectively, and with the faceplate in its left and right pivoted positions respectively.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring more particularly to the drawings, FIGS. 1 and 2 illustrate a refuse collection truck 10 which embodies the present invention. As is conventional, the truck 10 includes an operator cab 12 at the front end, and a refuse collection hopper 14 mounted on the bed of the truck behind the cab. Also, in the illustrated embodiment, the hopper 14 is divided into two chambers 14A, 14B by a transverse divider panel 15 which extends across the refuse opening in the top of the hopper, and horizontally through the central portion of the hopper, and so as to divide the hopper into an upper chamber 14A and a lower chamber 14B. The rear end of the hopper includes a double jointed tailgate 16 so as to permit the chambers to be individually emptied. Thus, the truck is adapted to separately receive, for example, recyclable waste in chamber 14A and nonrecyclable waste in chamber 14B. Alternatively, it is also possible to collect a different type of recyclable waste in each of the chambers.

The truck 10 is adapted to engage and empty refuse collection containers 20 which are positioned along the roadside by homeowners, businesses, and the like. The containers 20 may be of the type illustrated, for example in U.S. Pat. No. 5,119,894, the disclosure of which is incorporated herein by reference. Such containers include one side which is adapted to be engaged and gripped by the lifting mechanism of the vehicle as further described below. The container may also include a vertical internal divider wall 22 which divides the interior thereof into two adjacent sides. These two sides may be designated to receive two types of waste, such as recyclables and nonrecyclables, so that the initial sorting of the waste is done by the homeowner as the waste is deposited in the container.

The truck mounts an elongate lift arm 24 which extends longitudinally along one side of the vehicle. The lift arm 24 is mounted to the truck by a conventional hydraulic lifting mechanism 25 as known in the art, and which is capable of moving the lift arm between (a) a lowered position wherein the lift arm extends longitudinally along the side of the vehicle and (b) a raised dump position wherein the lift arm extends longitudinally along the open top of the hopper and is rotated about a longitudinal axis 26 from its rotational orientation in the lowered position. The two positions are illustrated in FIGS. 1 and 2. Also, in the lowered position, the lift arm may be moved laterally away from the truck and toward a container as illustrated by the arrow 27 in FIG. 2. One example of a hydraulic lift mechanism which is operable in the described manner is manufactured by Wayne Engineering Company of Cedar Rapids, Iowa, under the trademark "Curb Tender".

Figure 5:
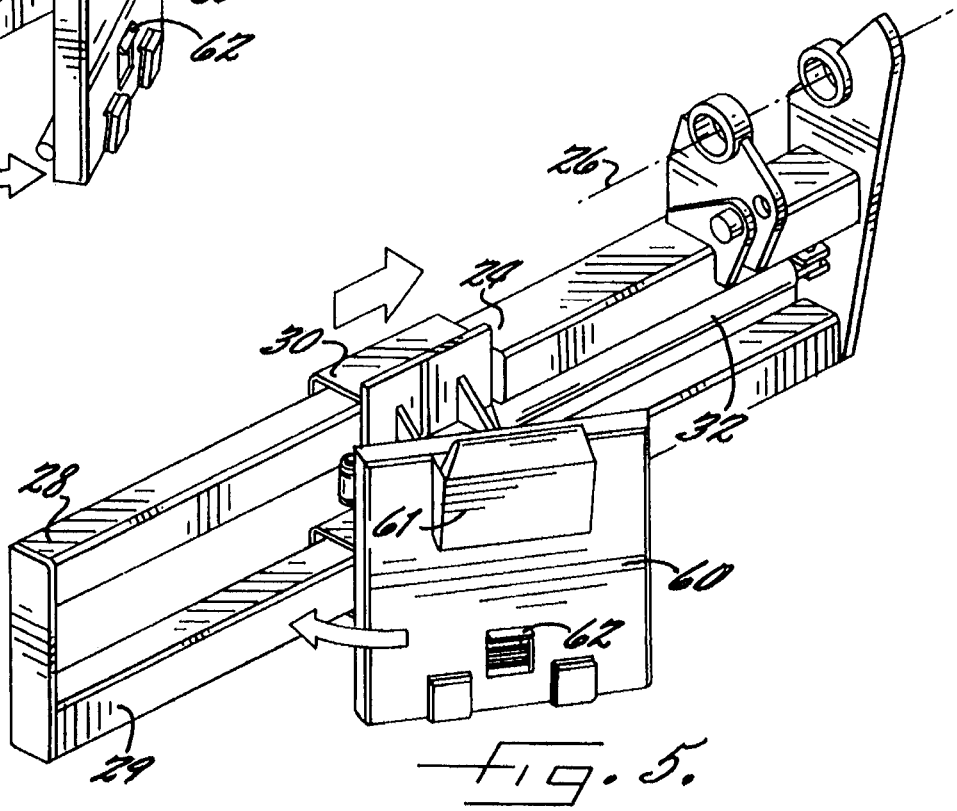

The lift arm 24 of the present invention further includes a pair of longitudinally extending guide posts 28, 29, and a slide 30 mounted to the guide posts for slideable movement along the longitudinal direction. In particular, the slide 30 is moveable to a central position as illustrated in FIG. 3, an extended position on one side of the central position as illustrated in FIG. 4, and a retracted position on the other side of the central position as illustrated in FIG. 5. Typically, the extended position and the retracted position are disposed about 15 inches from the central position, so as to provide a travel distance for the slide of about 30 inches.

Figure 11:
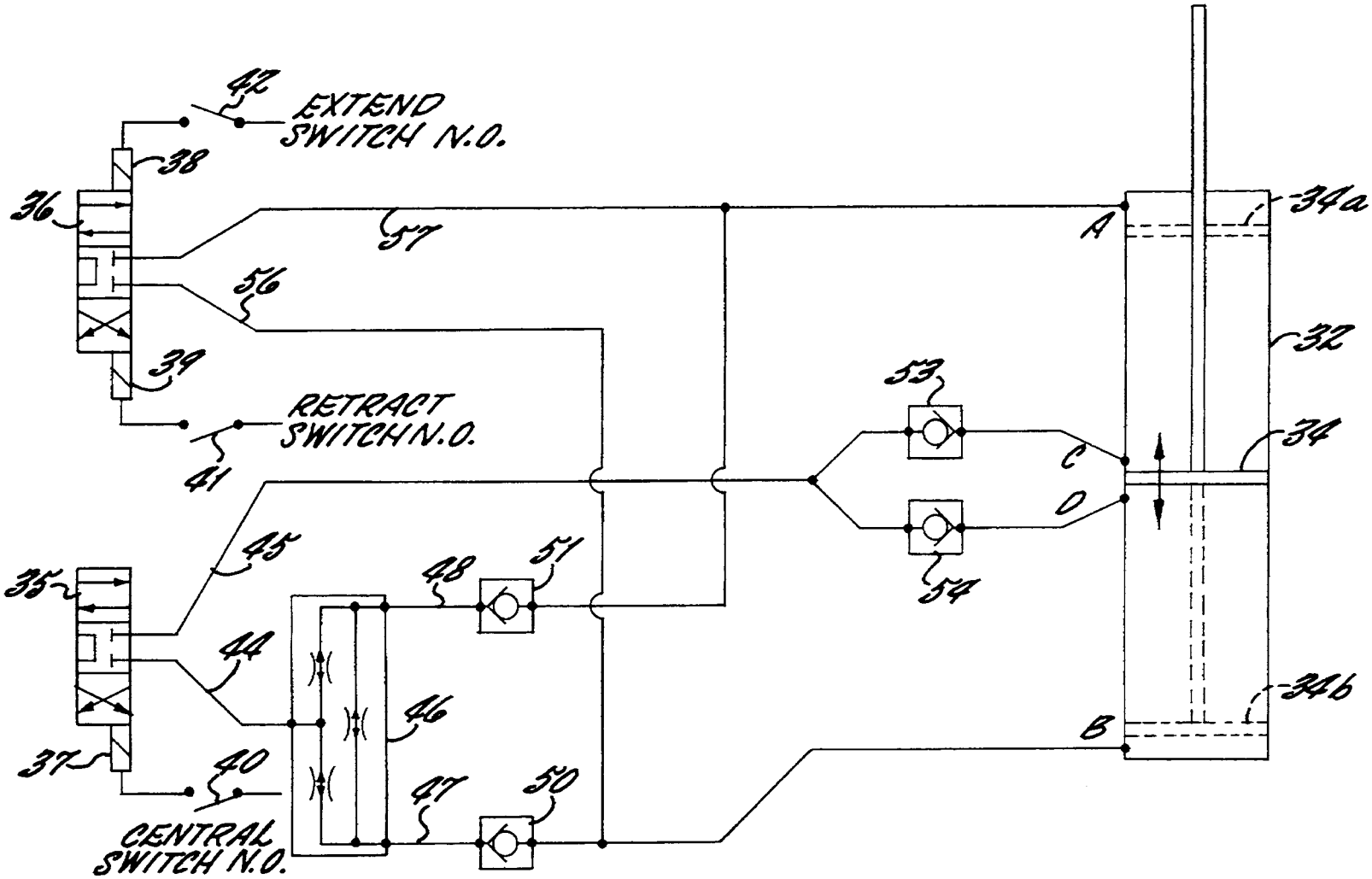
FIG. 11 is a schematic diagram of the hydraulic drive means for the slide of the lift arm.

A drive system is provided for moving the slide in each longitudinal direction along the guide posts 28, 29 of the lift arm 24. In the illustrated embodiment, the drive system includes a longitudinally extending hydraulic cylinder 32 connected between the lift arm and the slide, and the cylinder 32 is controlled by a hydraulic circuit and control switches as illustrated in FIG. 11. More particularly, the circuit includes four spaced apart ports A, B, C, and D in the hydraulic cylinder 32, and so that the piston 34 may be moved between a central position, an extended position 34*a*, and a retracted position 34*b*. A pair of two position, four-way hydraulic valves 35, 36 are provided, and the two valves are controlled by three solenoids 37, 38, 39, which are in turn controlled by three switches 40, 41, 42. When the central switch 40 is closed, the solenoid 37 is actuated, and the valve 35 is shifted so as to direct the pressurized hydraulic fluid into the line 44, while the line 45 is connected to the tank. The line 44 leads to a conventional flow divider 46, and then to two output lines 47, 48. The flow divider 46 assures that both of the output lines 47, 48 receive an equal flow, rather than having all of the fluid pass through the line of least resistance.

One way valves 50, 51 are positioned in the output lines 47, 48 respectively, and the lines 47, 48 then lead to the ports A and B. The piston 34 is thus moved to its central position, with the ports C and D being open to the tank via the two parallel branches of the line 45 and which include one-way valves 53, 54.

When the extend switch 42 is closed, the solenoid 38 is actuated causing the valve 36 to move to its first position, so that the line 56 is pressurized, and the line 57 is connected to the tank. Thus the port B of the hydraulic cylinder 32 is pressurized, and since the ports C and D are closed to flow, the piston 34 moves upwardly toward its extended position.

Movement in the reverse or retracted direction is achieved by closing the retract switch 41, which actuates the solenoid 39 and acts to move the valve 36 to it second position. In this position, the line 57 is pressurized and the line 56 is connected to the tank.

A faceplate 60 is mounted to the slide 30, and includes conventional means for engaging the engageable side of the refuse container, such as an upper hanger 61 and a lower latch 62. The manner in which the container is gripped by a faceplate of this type is further described in the above referenced U.S. Pat. No. 5,119,894.

Figure 6:
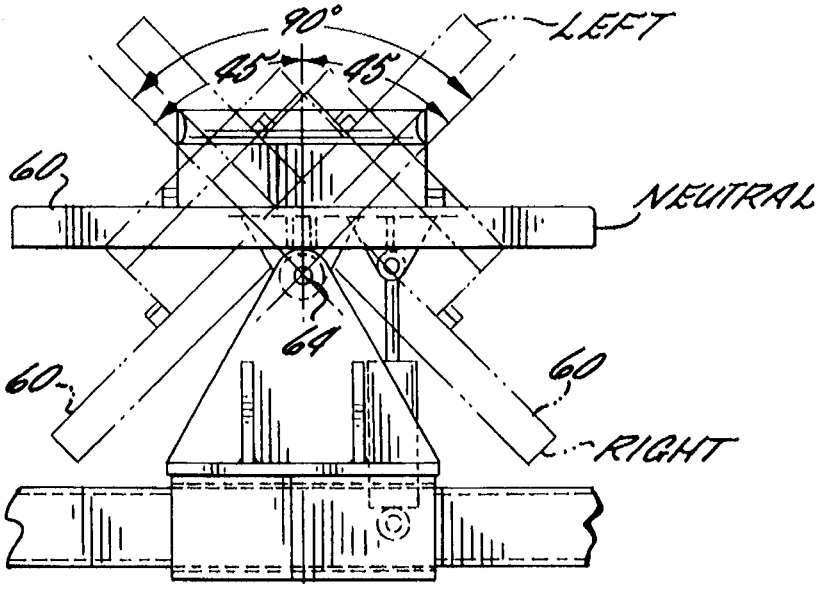
FIG. 6 is a fragmentary top plan view of the slide and faceplate, and illustrating the pivotal movement of the faceplate in dashed lines.

The faceplate 60 is mounted to the slide 30 for pivotal movement about a pivot axis 64 (FIG. 6) which is generally parallel to the faceplate and vertically oriented when the lift arm 24 is in its lowered position. It is to be understood that the faceplate 60 may be directly mounted to the lift arm 24 without the slide 31 and remain within the spirit of the invention. In all other respects, such a configuration operates in the manner described below. As best seen in FIG. 6, the faceplate 60 is moveable about the axis 64 between a neutral position, a first or right pivoted position on one side of the neutral position, and a second or left pivoted position on the other side of the neutral position.

Figure 7:
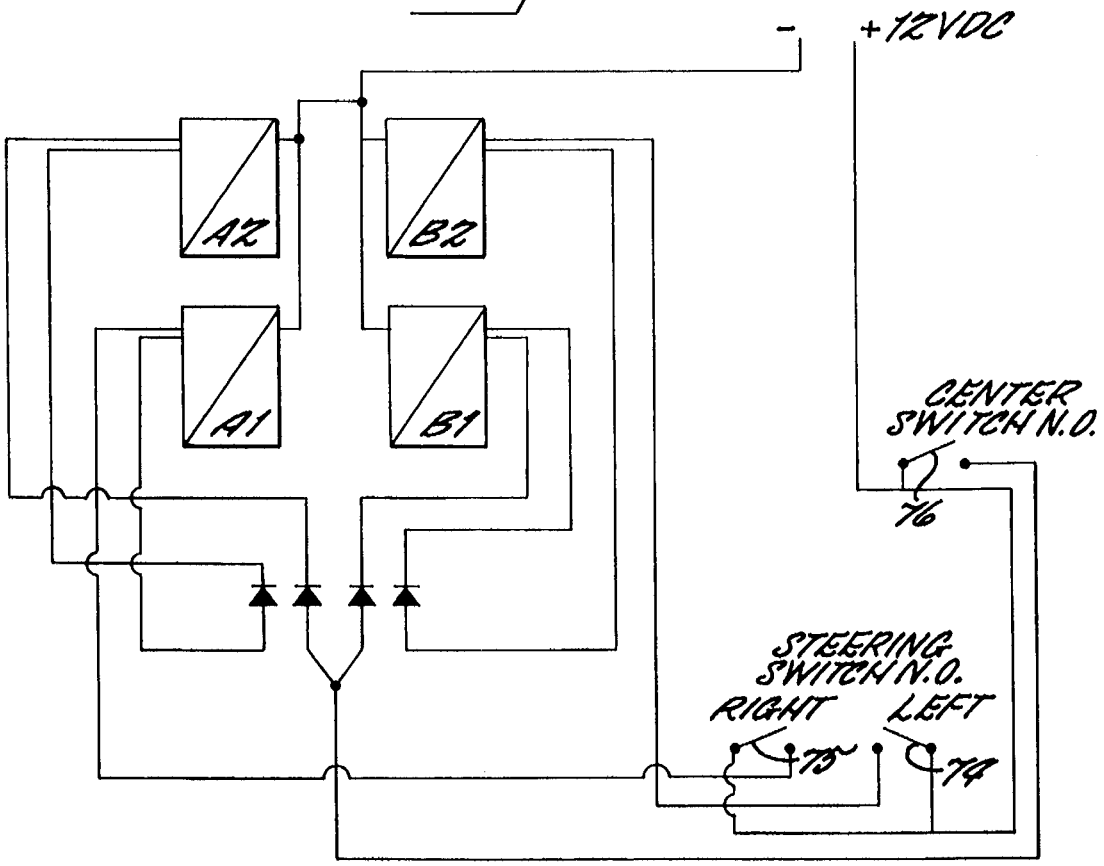
FIGS. 7 and 8 are schematic illustrations of the pivotal drive means for the faceplate of the present invention.
Figure 8:
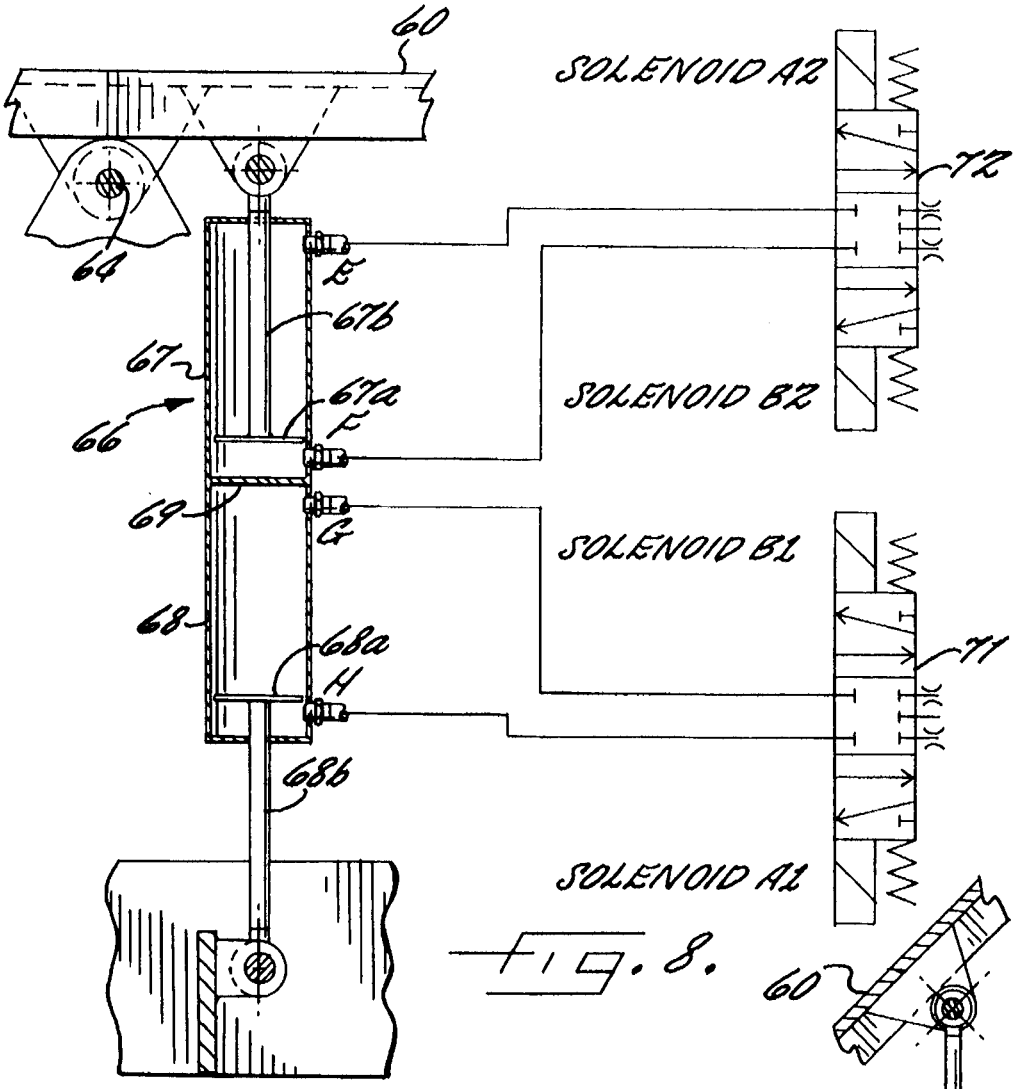

To effect the pivotal movement of the faceplate, there is provided a pneumatic drive system as illustrated in FIGS. 7 and 8. The pneumatic drive system comprises a cylindrical housing 66 which has two fluid chambers 67, 68 connected in axial alignment, with a common base plate 69 and with each of the cylinders including a piston 67*a*, 68*a* slideably mounted therein and a rod 67*b*, 68*b* connected to the piston and extending in opposite directions from the two cylinders. The piston rod 68*b* is pivotally connected to the slide, and the piston rod 67*b* is pivotally connected to the faceplate.

The cylinder 67 comprises two ports E, F positioned at the opposite ends thereof, and the cylinder 68 comprises two ports G, H at the respective ends thereof. A pair of two position, four-way pneumatic valves 71, 72 are also provided, and each valve is controlled by a pair of solenoids A1, B1 and A2, B2, respectively. An electric circuit as illustrated in FIG. 7 is provided to operate the solenoids, and which includes left and right switches 74, 75, and a center or neutral switch 76.

Figure 9:
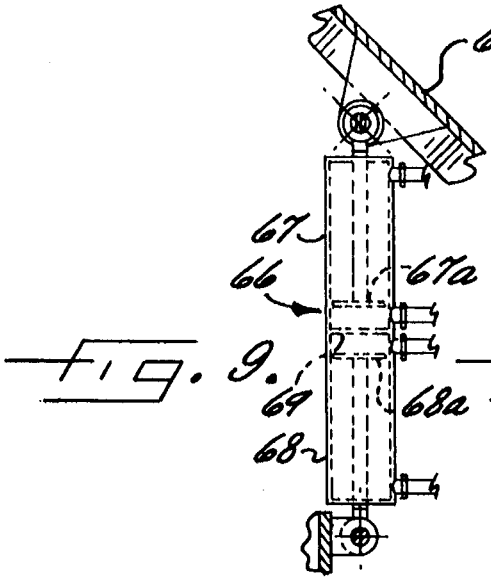
FIGS. 9 and 10 illustrate the pneumatic cylinder of FIG. 8 in the right and left positions of the faceplate respectively.
Figure 10:
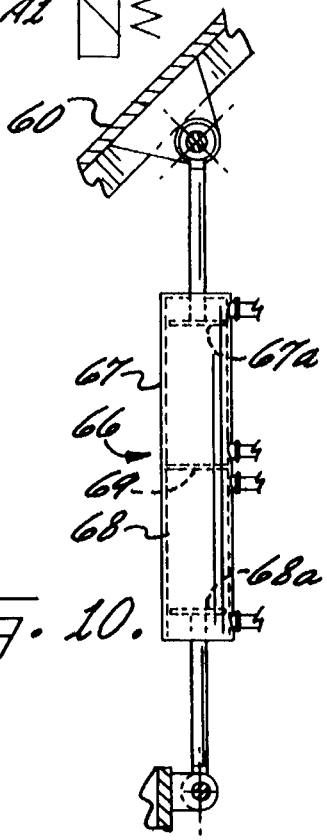

To position the faceplate 60 in its neutral position, the neutral switch 76 is closed, which actuates the solenoids A2 and B1. Pressurized air is thus directed to the ports E and G, causing the piston 68*a* to be extended and the piston 67*a* to be retracted. When the right switch 75 is closed, the solenoids A2 and A1 are actuated so that air is directed to the ports E and H, causing both of the pistons to be retracted, note FIG. 9. When the left switch 74 is closed, solenoids B2 and B1 are actuated and the ports F and G are pressurized, causing both pistons to be extended, note FIG. 10.

Alternative drive systems may be used to drive the pivotal faceplate and remain within the spirit of this invention. For example, the drive system may be hydraulic which would allow it to be incorporated into the existing hydraulic system of the truck. Similarly, an electrical drive system may be used and incorporated into the refuse truck's existing electrical system. An advantage of using the disclosed pneumatic system is that the drive system and the pivotal faceplate 60 may easily be retrofitted as a self-contained unit onto an existing refuse truck without having to tie into the truck's hydraulic system and only minor connections to the electrical system.

The illustrated embodiment of the refuse collection vehicle further comprises a video camera 80 mounted on one side of the collection hopper of the vehicle, and positioned so as to observe a refuse container 20 positioned along the side of the roadway and adjacent the lift arm 24. A video display screen 82 is operatively connected to the output of the camera, and is positioned in the cab 12 so that the operator of the vehicle can observe the position and orientation of the refuse container from the cab. Also, the switches 40, 41, 42 for the hydraulic control of the cylinder 32, and the switches 74, 75, 76 for the pneumatic control of the faceplate 60, are all located in the cab 12 so as to be accessible by the operator while viewing the video display screen 82. Thus the operator is able to orient the faceplate 60 with respect to a particular refuse container, so as to engage and grip the container, without leaving the cab. The flexibility of the device and its easy manipulation by the operator enables the faceplate 60 to be operated much like a robotic arm to reach out and engage a container, as well as return it to its original position even in confined spaces and even though the container is improperly oriented with respect to the faceplate.

DESCRIPTION OF THE OPERATION OF THE VEHICLE

The sequence of events involved in the collection of refuse from a refuse container will now be described. In this regard, it will be understood that the refuse containers 21 are typically positioned along the roadside by homeowners, businesses, and the like, and the containers will thus not necessarily be properly oriented so that their engageable sides are aligned to face perpendicularly across the roadway. In reality, many of the containers will be misaligned so that the sides to be engaged are at an angle to the roadway.

With the present invention, the truck operator is able to pull alongside a refuse container 20, observe its orientation on the video screen 82, and orient the faceplate 60 about the pivotal axis 64 and so as to match the orientation of the container. The container may then be engaged by moving the faceplate laterally along the direction of the arrow 27 in FIG. 2 and into contact with the engageable side of the container. Closing of the switch 76 by the operator then causes the faceplate 60 and the retained container 20 to become properly, i.e. squarely, aligned with the truck, and the closing of the switch 40 by the operator then causes the faceplate and engaged container to be moved to the central position of the lift arm as seen in FIG. 3. The lift arm 24 may then be lifted in the normal manner by the lifting mechanism 26 to deposit the contents of the container 20 into the hopper 14.

Where the vehicle hopper includes a divider panel 15 and two chambers 14A, 14B, it is desirable that the central position of the slide 30 and faceplate 60 be longitudinally aligned with the divider panel 15 of the hopper. This permits the slide and faceplate, and thus the engaged refuse container, to be moved forward or backward, typically by about 15 inches in each direction, from the center position. Where non-divided containers are utilized, the contents may thus be dumped into either one of the two chambers. This is particularly advantageous where the containers are designated to contain either recyclable waste or nonrecyclable waste.

Where divided or split containers as described above are utilized, the operator may easily bring the container to the central position by closing the switch 40. When the thus positioned container reaches the dump position, the contents of one side of the container fall into one chamber, and the contents of the other side of the container fall into the other chamber.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. An apparatus for engaging and lifting a refuse container so that contents thereof can be dumped into a refuse collection hopper, and comprising a lift arm, means for selectively moving said lift arm between a lowered receiving position and a raised dumping position, a faceplate mounted generally parallel to said lift arm for pivotal movement about a pivot axis which is generally parallel to said faceplate and vertically oriented when said lift arm is in said receiving position said faceplate being pivotable about said pivot axis between a neutral position in a substantially vertical plane substantially parallel to a longitudinal axis of the refuse collection hopper, a first pivoted position on one side of said neutral position, and a second pivoted position on the other side of said neutral position, means mounted on said faceplate for engaging a refuse container, and drive means for selectively pivoting said faceplate about said pivot axis between said neutral position, said first position, and said second position, and so that said container engaging means on said faceplate can be oriented about said pivot axis to engage a refuse container when the lift arm is in said receiving position;

whereby said face plate can be aligned with a refuse container prior to engagement therewith to facilitate engaging and lifting the refuse container when positioned in confined spaces and when the refuse container is misaligned relative to the refuse collection hopper.

2. The apparatus as defined in claim 1 wherein said drive means includes switch means for, upon being actuated, automatically moving said faceplate to said neutral position.

3. The apparatus as defined in claim 1 wherein said drive means comprises two fluid cylinders connected in axial alignment, with each of said cylinders including a piston slideably mounted therein and a rod connected to the piston, and with the pistons and rods of the two cylinders being oriented in a back to back arrangement so that the rods extend in opposite directions from the two cylinders.

4. The apparatus as defined in claim 3 wherein one of said piston rods is pivotally connected to said lift arm and the other of said piston rods is pivotally connected to said faceplate.

5. The apparatus as defined in claim 4 wherein said drive means further comprises first switch means for moving one of said pistons to an extended position and the other of said pistons to a retracted position to define said neutral position of said faceplate, second switch means for moving both of said pistons toward their extended positions where they define said first pivoted position of said faceplate, and third switch means for moving both of said pistons toward their retracted positions where they define said second pivoted position of said faceplate.

6. The apparatus as defined in claim 5 wherein said first pivoted position is at least about 45 degrees on said one side of the neutral position and the second pivoted position is at least about 45 degrees on the other side of the neutral position.

7. A refuse collection apparatus comprising:

a roadway vehicle having front and rear ends defining a longitudinal direction therebetween, and opposite sides, a refuse collection hopper having an open top and mounted to said vehicle, an elongate lift arm which defines a longitudinal axis, means mounting said lift arm to said vehicle and for selective movement between (a) a lowered receiving position wherein said lift arm extends longitudinally along one side of said vehicle and (b) a raised dumping position wherein said lift arm extends longitudinally along the open top of said collection hopper and is rotated about the longitudinal axis from its rotational orientation in said receiving position, a slide mounted to said lift arm for slideable movement along the longitudinal direction, first drive means for selectively moving said slide in each longitudinal direction along said lift arm, a faceplate mounted to said slide for pivotal movement about a pivot axis which is generally parallel to said faceplate and vertically oriented when said lift arm is in said receiving position, means mounted on said faceplate for engaging a refuse container, and second drive means for selectively pivoting said faceplate about said pivot axis between a neutral position in a substantially vertical plane substantially parallel to a longitudinal axis of said refuse collection hopper, a first pivoted position on one side of said neutral position and a second pivoted position on the other side of said neutral position, whereby in said receiving position of said lift arm, the faceplate can be longitudinally moved and pivotally rotated about said pivot axis so as to engage a refuse container, and the container may then be lifted by said lift arm to said dumping position where it is tilted so that contents of the container fall into said collection hopper.

8. The refuse collection apparatus as defined in claim 7 wherein said second drive means includes switch means for, upon being actuated, automatically moving said faceplate to said neutral position.

9. The refuse collection apparatus as defined in claim 8 wherein said first drive means comprises means for moving said slide between a central position along said lift arm, a forward position on one side of said central position, and a retracted position on the other side of said central position.

10. The refuse collection apparatus as defined in claim 9 wherein said first drive means includes switch means for, upon being actuated, automatically moving said slide to said central position.

11. The refuse collection apparatus as defined in claim 10 further comprising an operator cab, a camera mounted to said vehicle so as to observe a refuse container positioned adjacent said lift arm, and a video display screen operatively connected to said camera and positioned in said cab so that the operator of the vehicle can observe from the cab both position and orientation of a refuse container which is located adjacent said lift arm.

12. The refuse collection apparatus as defined in claim 11 wherein said switch means of said first drive means and said switch means of said second drive means are positioned in said cab so as to be accessible to the operator while observing said video screen.

13. The refuse collection apparatus as defined in claim 12 wherein said refuse collection hopper includes a transverse divider panel at said open top for dividing the hopper into two separate chambers, and so that the contents of a refuse container can be dumped into a selected one of said chambers, or into both of said chambers, by selecting the position of said slide along said lift arm.

14. The refuse collection apparatus as defined in claim 7 wherein said second drive means comprises two fluid cylinders connected in axial alignment, with each of said cylinders including a piston slideably mounted therein and a rod connected to the piston, and with the pistons and rods of the two cylinders being oriented in a back to back arrangement so that the rods extend in opposite directions from the two cylinders.

15. The refuse collection apparatus as defined in claim 14 wherein one of said piston rods is pivotally connected to said slide and the other of said piston rods is pivotally connected to said faceplate.

16. The refuse collection apparatus as defined in claim 15 wherein said second drive means further comprises first switch means for moving one of said pistons to its extended position and the other of said pistons to its retracted position to define said neutral position of said faceplate, second switch means for moving both of said pistons toward their extended positions where they define said first pivoted position of said faceplate, and third switch means for moving both of said pistons toward their retracted positions where they define said second pivoted position of said faceplate.

17. The refuse collection apparatus as defined in claim 16 wherein said first pivoted position is at least about 45 degrees on said one side of the neutral position and the second pivoted position is at least about 45 degrees on the other side of the neutral position.

18. A refuse collection apparatus comprising a refuse collection container having a vertical divider wall which divides an interior thereof into two adjacent sides, a roadway vehicle having front and rear ends defining a longitudinal direction therebetween, and opposite sides, a refuse collection hopper having an open top and mounted to said vehicle, said collection hopper including a transverse divider panel at said open top for dividing the hopper into two separate chambers, an elongate lift arm, means mounting said lift arm to said vehicle and for selective movement between (a) a lowered receiving position wherein said lift arm extends longitudinally along one side of said vehicle and (b) a raised dumping position wherein said lift arm extends longitudinally along the open top of said collection hopper and is rotated about a longitudinal axis from its rotational orientation in said receiving position, a slide mounted to said lift arm for slideable movement along the longitudinal direction, first drive means for selectively moving said slide in each longitudinal direction along said lift arm, a faceplate mounted to said slide for pivotal movement about a pivot axis which is generally parallel to said faceplate and vertically oriented when said lift arm is in said receiving position, means mounted on said faceplate for engaging said refuse collection container, and second drive means for selectively pivoting said faceplate about said pivot axis between a neutral position in a substantially vertical plane substantially parallel to a longitudinal axis of said refuse collection hopper, a first pivoted position on one side of said neutral position and a second pivoted position on the other side of said neutral position, whereby in the lowered position of said lift arm, the faceplate can be longitudinally moved and pivotally rotated so as to engage a refuse container, and the container may then be lifted by said lift arm to said raised dump position where it is tilted so that contents of the container fall into said refuse collection hopper, and whereby the refuse collection container can be positioned so that the contents of one side thereof falls into one of said chambers of said hopper, and the contents of the other side falls into the other of said chambers of said hopper.

19. The refuse collection apparatus as defined in claim 18 wherein said second drive means includes switch means.

20. The refuse collection apparatus as defined in claim 19 wherein said first drive means comprises means for moving said slide between a central position along the length of said lift arm, a forward position on one side of said central position, and a retracted position on the other side of said central position, and wherein said first drive means includes switch means for, upon being actuated, automatically moving said slide to said central position.

21. The refuse collection apparatus as defined in claim 20 further comprising an operator cab, a camera mounted to said vehicle so as to observe the refuse container when it is positioned adjacent said lift arm, and a video display screen operatively connected to said camera and positioned in said cab so that the operator of the vehicle can observe the position and orientation of the refuse container from the cab, and wherein said first and second drive means include operator controls which are positioned in said cab so as to be accessible to the operator while observing said video screen.

22. An apparatus adapted for use with a lift arm of a refuse vehicle for engaging a refuse container in a lowered receiving position so that contents thereof can be lifted and dumped into a refuse collection hopper, said apparatus comprising:

a faceplate adapted for mounting to the lift arm for pivotal movement about a pivot axis which is generally parallel to the faceplate and vertically oriented when the lift arm is in the lowered receiving position;

engaging members mounted on said faceplate for engaging a refuse container; and a drive system adapted for connection to the refuse vehicle for selectively pivoting said faceplate about said pivot axis between a neutral position in a substantially vertical plane substantially parallel to a longitudinal axis of said refuse collection hopper, a first pivoted position on one side of said neutral position and a second pivoted position on the other side of said neutral position, so that said engaging members on said faceplate can be oriented about said pivot axis to engage a refuse container when the lift arm is in the receiving position.

23. The apparatus as defined in claim 22 wherein said drive system comprises a pair of fluid cylinders connected in axial alignment and oriented in back to back arrangement, each of said pair of cylinders including a piston slideably mounted therein and a rod connected to said piston, such that said pistons and said rods of said pair of cylinders extend in opposite directions therefrom.

24. The apparatus as defined in claim 23 wherein one of said piston rods is pivotally connected to the lift arm and the other of said piston rods is pivotally connected to said faceplate.

25. The apparatus as defined in claim 24 wherein said drive system further comprises:

a first switch for moving one of said pistons to an extended position and the other of said pistons to a retracted position to define said neutral position of said faceplate;

a second switch for moving both of said pistons toward their extended positions where they define said first pivoted position of said faceplate; and a third switch for moving both of said pistons toward their retracted positions where they define said second pivoted position of said faceplate.

26. The apparatus as defined in claim 25 wherein said first pivoted position is at least about 30 degrees on said one side of the neutral position and the second pivoted position is at least about 45 degrees on the other side of the neutral position.

* * * * *

UNITED STATES PATENT AND TRADEMARK OFFICE

CERTIFICATE OF CORRECTION

PATENT NO. : 5,525,022

DATED : June 11, 1996

INVENTOR(S) : Huntoon

It is certified that error appears in the above-identified patent and that said Letters Patent is hereby corrected as shown below:

On the cover page, Abstract, column 2, line 7, "track" should be -- truck --.

Column 3, line 61, "some" should be -- Some --.

Column 7, line 24, "21" should be -- 20 --.

Column 11, line 18, at the end of the line after "means" insert -- for, upon being actuated, automatically moving said faceplate to said neutral position --.

Signed and Sealed this

Twenty-seventh Day of August, 1996

*Attest:*

Bruce Lehman

BRUCE LEHMAN

*Attesting Officer*

*Commissioner of Patents and Trademarks*